US012311283B2

(12) United States Patent
Ng et al.

(10) Patent No.: US 12,311,283 B2
(45) Date of Patent: May 27, 2025

(54) TOY PROJECTILE WITH VENTED SUCTION CUP HEAD

(71) Applicant: Random Mills, LLC, Morristown, NJ (US)

(72) Inventors: Chun Kit Ng, Kowloon (HK); Peter Cummings, Kowloon (HK); Matthew B. Wendorff, Morris Plains, NJ (US); John Kiely, Morristown, NJ (US); Keith Kristiansen, Stratford, CT (US)

( * ) Notice: Subject to any disclaimer, the term of this patent is extended or adjusted under 35 U.S.C. 154(b) by 774 days.

(21) Appl. No.: 17/556,909

(22) Filed: Dec. 20, 2021

(65) Prior Publication Data

US 2022/0111302 A1 Apr. 14, 2022

Related U.S. Application Data

(63) Continuation-in-part of application No. 16/547,560, filed on Aug. 21, 2019, now Pat. No. 11,202,970.

(60) Provisional application No. 62/721,571, filed on Aug. 22, 2018.

(51) Int. Cl.
*A63H 33/18* (2006.01)
*A63H 33/30* (2006.01)

(52) U.S. Cl.
CPC ..... *A63H 33/18* (2013.01); *A63H 33/3072* (2013.01)

(58) Field of Classification Search
CPC ..... A63H 33/103; A63H 33/18
USPC ..... 446/177, 473; 473/572
See application file for complete search history.

(56) References Cited

U.S. PATENT DOCUMENTS 1,601,885 A * 10/1926 Samsel ..... F42B 6/003 D21/387
1,774,765 A 9/1930 Schoen
1,814,055 A * 7/1931 Napier ..... A63H 27/10 446/177
1,918,718 A * 7/1933 Samsel ..... F42B 6/003 273/DIG. 25
2,119,524 A * 6/1938 Yew ..... F42B 4/16 D21/387
2,717,442 A 9/1955 Smith
2,738,815 A 3/1956 Hoeldtke
2,910,995 A * 11/1959 Jacuzzi ..... A47B 91/066 248/362
2,930,161 A * 3/1960 Hellman ..... F42B 6/00 473/586
3,059,952 A * 10/1962 Wittman ..... E05C 19/18 292/264
3,378,260 A 4/1968 Hartel
3,454,278 A * 7/1969 Julius ..... F42B 6/003 473/586
3,467,385 A 9/1969 Liston
(Continued)

FOREIGN PATENT DOCUMENTS

GB 2267444 A 12/1993

*Primary Examiner* — Joseph B Baldori
(74) *Attorney, Agent, or Firm* — LaMorte & Associates PC

(57) ABSTRACT

A projectile toy with a body and at least one suction cup. Each suction cup assembly has a cup structure capable of adhering to a surface with suction and a vent valve for venting the suction. The vent valve automatically vents the cup structure only when a pull force is applied to the body. The vent valve is normally closed. When the body of the projectile toy is pulled, the suction cup moves relative to the body and opens the vent valve. In this manner, the toy projectile can be easily pulled from surfaces without damaging the toy projectile.

13 Claims, 5 Drawing Sheets

(56) References Cited

U.S. PATENT DOCUMENTS 3,584,908 A * 6/1971 Ray ..... A61F 9/0061 294/1.2
3,655,193 A * 4/1972 Jones ..... A63F 9/02 248/363
3,801,102 A * 4/1974 Lohr ..... F42B 6/003 29/451
3,841,628 A 10/1974 Goldfarb
3,968,784 A * 7/1976 Miller ..... F41B 7/003 124/31
4,030,761 A 6/1977 Daller
4,212,285 A * 7/1980 Cagan ..... F42B 6/10 124/67
4,235,041 A 11/1980 Sweet
D270,654 S 9/1983 Barrett
4,537,176 A * 8/1985 Stravitz ..... F42B 6/00 124/83
4,887,820 A * 12/1989 Amici ..... A63B 60/12 273/DIG. 25
5,066,017 A * 11/1991 Kurland ..... F42B 6/003 473/586
5,066,018 A 11/1991 Hinton
5,199,716 A 4/1993 DeFluiter et al.
5,265,883 A 11/1993 Choo
5,294,130 A 3/1994 Woods
5,306,059 A * 4/1994 Pirrallo ..... B65G 7/12 473/56
D360,913 S 8/1995 Choi
5,603,503 A * 2/1997 Lapidus ..... F41J 3/02 273/348.2
6,083,122 A * 7/2000 Brown ..... A63B 57/10 473/401
6,533,634 B1 * 3/2003 Sugar ..... A63H 3/50 446/72
7,364,521 B2 * 4/2008 Yang ..... F41B 11/89 248/362
D622,325 S 8/2010 Walterscheid
7,775,918 B2 * 8/2010 Tsang ..... F42B 6/003 473/573
8,012,049 B1 9/2011 Walterscheid
D709,559 S 7/2014 Baumann et al.
D709,560 S 7/2014 Baumann et al.
9,091,514 B1 7/2015 Cummings
D805,129 S 12/2017 Nagata
10,213,932 B2 2/2019 Brobeil
10,724,832 B2 7/2020 Washington
11,202,970 B2 * 12/2021 Wendorff ..... A63H 33/3072
2015/0031266 A1 1/2015 Hochstrasser

* cited by examiner

TOY PROJECTILE WITH VENTED SUCTION CUP HEAD

RELATED APPLICATIONS

This application is a continuation-in-part of U.S. patent application Ser. No. 16/547,560, filed Aug. 21, 2019, which claims the benefit of U.S. Provisional Patent Application No. 62/721,571, filed Aug. 22, 2018.

BACKGROUND OF THE INVENTION

1. Field of the Invention

In general, the present invention relates to action skill toys with suction cup heads that are thrown or otherwise propelled toward a target. More particularly, the present invention relates to the structure of the suction cup and pressure relief mechanisms for such suction cups.

2. Prior Art Description

There are many different types of toys that use suction cups. One such category of toys is projectile launching toys, where the projectile contains an impact head with suction cups. For example, there are toy arrows with suction cup heads, toy darts with suction cup heads, and balls covered in suction cups. This enables the toy projectile to adhere to a smooth surface upon impact.

Toy projectiles tend to be made of lightweight materials, such as low-density plastic and synthetic foam. In this manner, the toy is unlikely to cause injury should the toy projectile accidently strike a person or animal. Since the projectile toys are made of lightweight materials, the projectile toys typically do not embody a large amount of structural strength. Projectile toys are typically made with suction cups that are strong enough to support the weight of the projectile. In this manner, the toy projectile can stick to a smooth surface and remain in place without immediately falling away. Accordingly, it often takes a significant amount of force to pull the suction cup of a projectile away from a surface. This is particularly true if the contacted surface is very smooth and the suction cup is wet prior to impact.

Since the materials of the toy projectile have limited strength, the body of the toy projectile can be damaged as forces are applied to the toy projectile when dislodging the suction cup. The damage often results in the suction cup separating away from the remainder of the toy projectile. The result is a toy projectile, without a suction cup. Such a projectile can cause injury or damage, should the projectile be again launched without its suction cup.

In order to limit the forces that need to be applied to a toy projectile to dislodge the suction cup, either smaller suction cups need to be used or the suction cups need to be vented. The use of smaller suction cups is not practical, because suction cups need to be large enough to support the weight of the projectile and to blunt any impact forces. Vented suction cups are also not practical because they only stick to surfaces for a few seconds before detaching. This detracts from the play value of the toy projectile system.

One solution to the problem is to use suction cups that contain a selectively controllable venting valve. In this manner, the suction cup can be vented and detached from a surface when desired. In the prior art, there are many suction cups that contain venting valves. However, the venting valves are typically connected to some manual control, such as a lever, butterfly nut, or turn cap. In this manner, the suction cups are vented only upon the manual turning of a control on the exterior of the suction cup. Such prior art is exemplified by U.S. Pat. No. 5,381,990 to Belokin, U.S. Pat. No. 10,520,009 to Smith, and GB Patent No. 2445840 to Chen.

There is an inherent problem in using such prior art venting mechanisms on the suction cups of projectile toys. Many of these venting mechanisms create high protrusions on the exterior of the suction cup that could cause injury should the structure strike someone. Furthermore, children are not likely to use a manual venting system. Rather, children are more likely to ignore the manual venting mechanism and simply pull the projectile and suction cup away from a surface. As such, the use of the venting mechanism does little to prevent damage to the toy projectile.

A need therefore exists for a toy projectile with a suction cup head, wherein the suction cup head automatically vents only when the toy projectile is being actively pulled away from a surface. This need is met by the present invention as described and claimed below.

SUMMARY OF THE INVENTION

The present invention is a projectile toy with at least one suction cup. The projectile toy has a body. At least one suction cup assembly extends from the body. Each suction cup assembly has a cup structure capable of adhering to a surface with suction and a vent valve for venting the suction. The vent valve automatically vents the cup structure only when a pull force is applied to the body. The vent valve is normally closed. When the body of the projectile toy is pulled, the suction cup moves relative to the body and opens the vent valve. In this manner, the toy projectile can be easily pulled from surfaces without damaging the toy projectile.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention projectile toy can be embodied in many ways, only two exemplary embodiments are illustrated and described. The exemplary embodiments set forth two of the best modes contemplated for the invention. The illustrated embodiments, however, are merely exemplary and should not be considered limitations when interpreting the scope of the appended claims.

Figure 1:
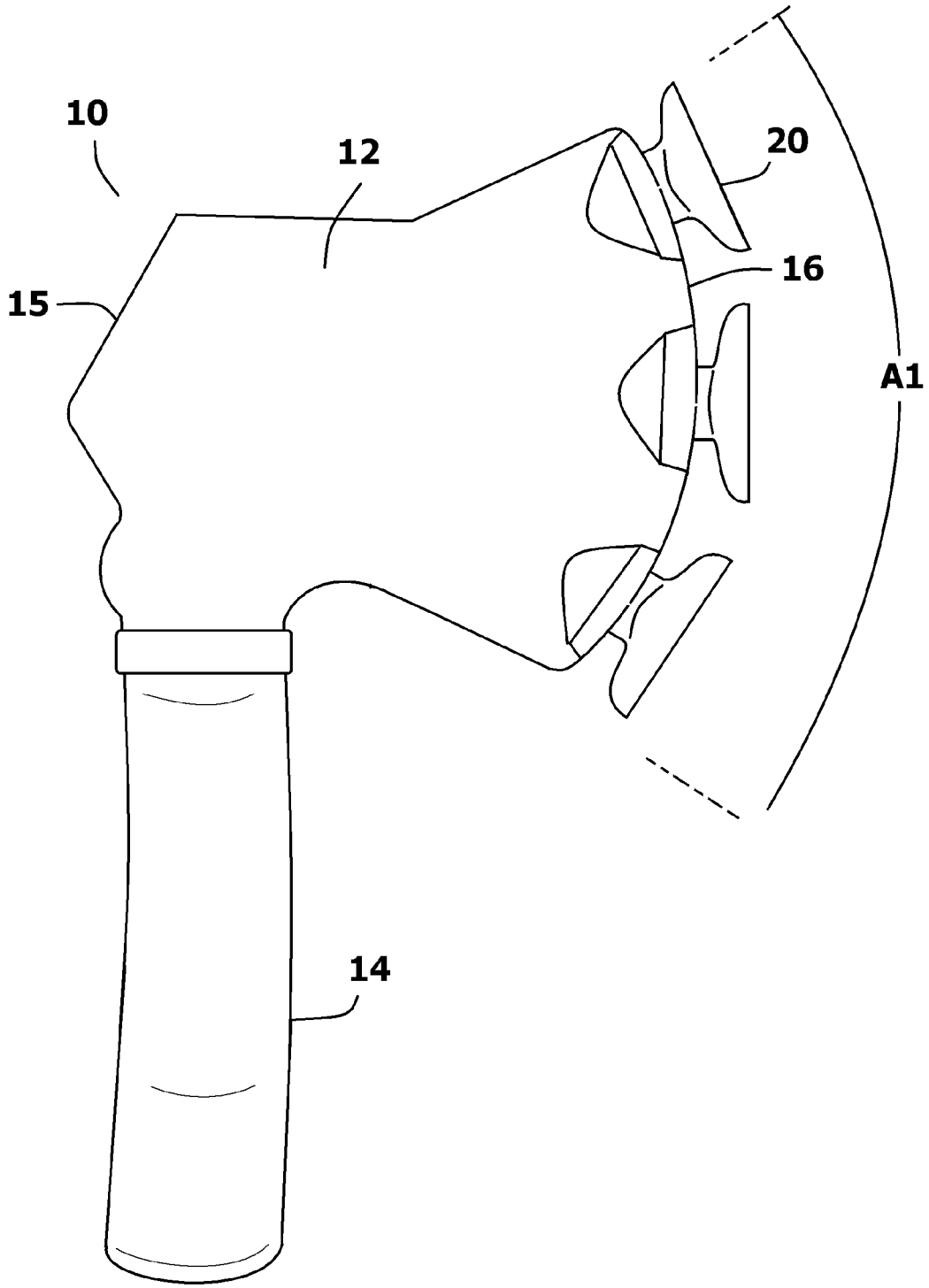
FIG. 1 show an exemplary embodiment of a projectile toy in the form of a toy axe.

Referring to FIG. 1, a projectile toy 10 is shown that is designed to be launched toward a flat surface. The exemplary projectile toy 10 being illustrated has the general configuration of an axe. That is, the projectile toy 10 has an axe-shaped head 12 positioned atop a handle 14. The axe-shaped head 12 and the handle 14 form the body 15 of the projectile toy 10. Both the axe-shaped head 12 and the handle 14 are made from soft lightweight molded materials. This limits the weight of the body 15 and provides the projectile toy 10 with a large size-to-weight ratio. In this manner, the projectile toy 10 is not dangerous as a blunt force object, should an individual throw the projectile toy 10 toward another.

The axe-shaped head 12 of the projectile toy 10 has a face edge 16. A plurality of suction cup assemblies 20 are attached to the face edge 16. The suction cup assemblies 20 are linearly aligned. The suction cup assemblies 20 have the ability to adhere to smooth, semi-smooth and even some rough surfaces for various periods of time. Due to the curved nature of the face edge 16, the suction cup assemblies 20 are each arranged at slightly different angles of inclination. It is preferred that at least one of the suction cup assemblies 20 is oriented at a perpendicular to the primary direction in which the handle 14 extends. In the shown embodiment, three suction cup assemblies 20 are provided. Such a number is arbitrary, and it will be understood that any number of suction cup assemblies 20 can extend from the body 15. The combined angles of inclination for all the suction cup assemblies 20 extend across an arcuate range A1. The arcuate range A1 is preferably between thirty degrees and eighty degrees. The arcuate range A1 depends upon the length of the face edge 16, the size of the suction cup assemblies 20 and the number of suction cup assemblies 20.

Figure 2:
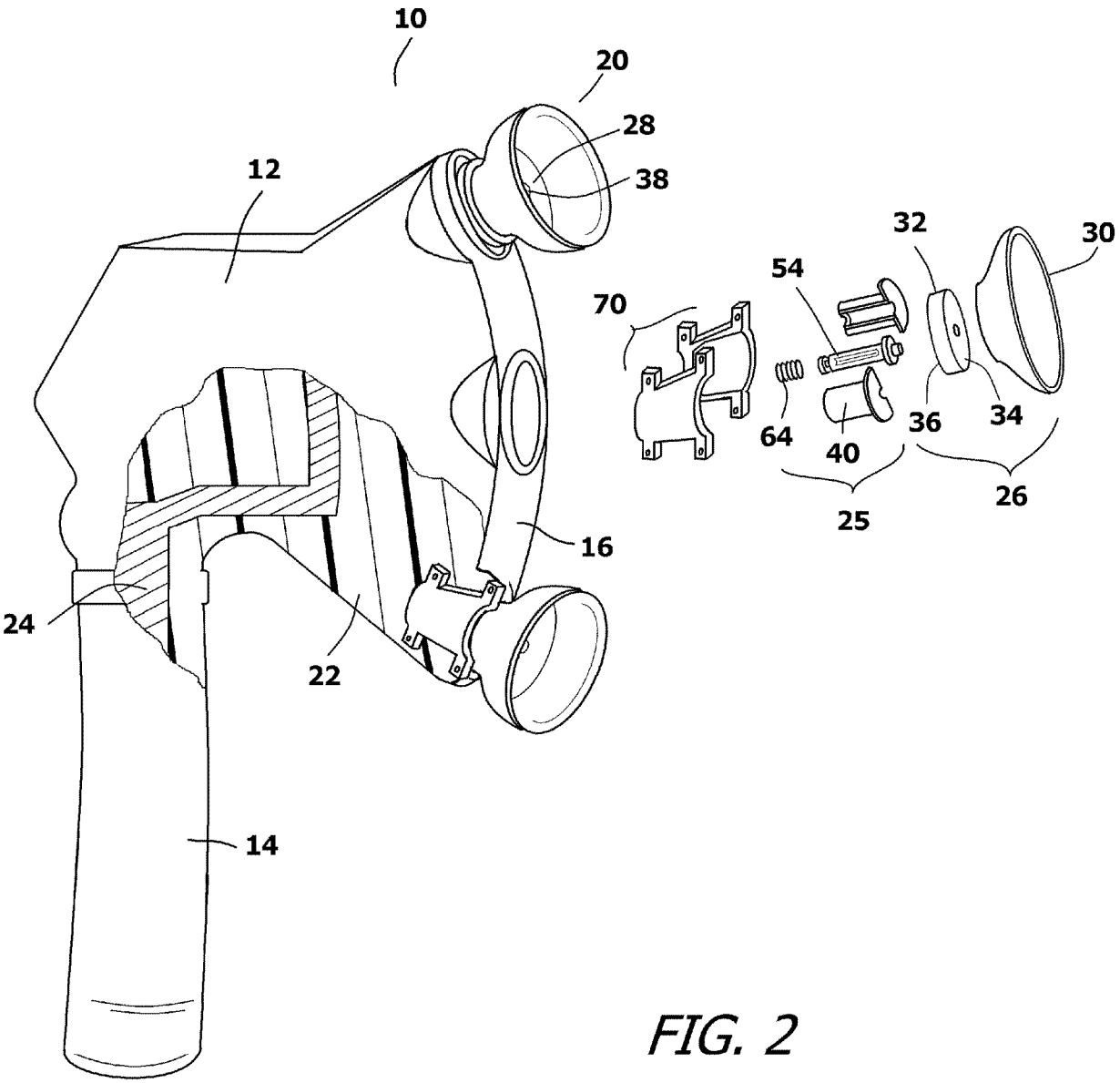
FIG. 2 is a partially exploded and fragmented view of the exemplary embodiment of FIG. 1.

The handle 14 extends from the bottom of the axe-shaped head 12. The handle 14 has a length that is at least as long as the width of the axe-shaped head 12. The handle 14 is preferably molded with the axe-shaped head 12 as a single unit to prevent the need for assembly. Referring to FIG. 2 in conjunction with FIG. 1, it will be understood that the handle 14 and the axe-shaped head 12 are molded primarily from a lightweight polymeric foam 22. This makes both the handle 14 and the axe-shaped head 12 lightweight. The polymeric foam 22 also provides the exterior surfaces of the handle 14 and the axe-shaped head 12 with a high degree of impact softness. Many polymeric foams have limited structural integrity. To provide better structural integrity to the projectile toy 10, at least one reinforcement element 24 can be provided within the polymeric foam 22. The reinforcement element 24 provides strength and stiffness to the handle 14 and to the transition between the handle 14 and the axe-shaped head 12. The reinforcement element 24 is completely encased within the polymeric foam 22. As such, the rigid plastic of the reinforcement element 24 is not a danger should the projectile toy 10 impact a person or delicate object.

Each suction cup assembly 20 includes a cup structure 26 and an automatic vent valve 25. The cup structure 26 has a flat central hub 28 and a concave cup 30 that radiates from the flat central hub 28. The cup structure 26 is preferably made from an elastomeric material. A base disc 32 attaches to the flat central hub 28 of the cup structure 26. The base disc 32 has a top surface 34 and a bottom surface 36. The base disc 32 has the same diameter as does the flat central hub 28 of the cup structure 26. A vent conduit 38 is formed through both the flat central hub 28 of the cup structure 26 and the base disc 32. The base disc 32 is preferably made from a closed cell foam or other such material that is highly compressible. The use of the base disc 32 is optional. However, the use of the base disc 32 is preferred because it enables the angle of the cup structure 26 to change on impact. The base disc 32 compresses to make the cup structure 26 more parallel to a surface on impact. This enables the cup structure 26 to better adhere to a surface even when impacting that surface at an angle.

Figure 3:
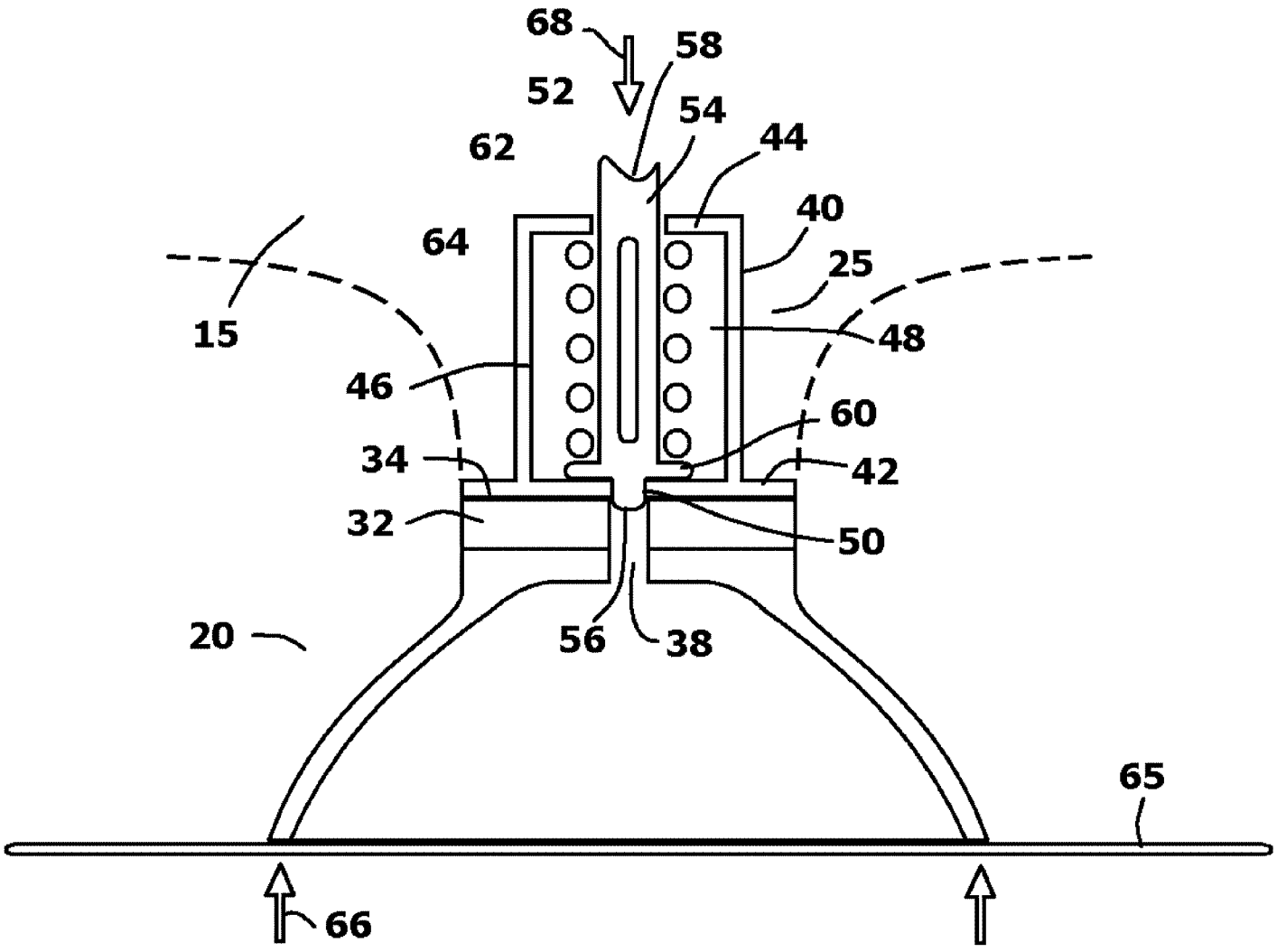
FIG. 3 shows the automatic vent valve used in the exemplary embodiment in a closed condition just after surface impact.

Referring to FIG. 3 in conjunction with FIG. 2, it can be seen that the automatic vent valve 25 is provided that closes the vent conduit 38 on impact. As will be explained, the automatic vent valve 25 opens the vent conduit 38 when the body 15 of the projectile toy 10 is pulled in an attempt to dislodge the cup structure 26. The automatic vent valve 25 includes a guide bonnet 40. The guide bonnet 40 has a bottom surface 42, a top surface 44 and a peripheral wall 46 that defines an inner chamber 48. The bottom surface 42 of the guide bonnet 40 is adhered to the top surface 34 of the base disc 32. A vent hole 50 is formed in the center of the bottom surface 42 of the guide bonnet 40 that aligns with the vent conduit 38 that passes through the base disc 32 and the flat central hub 28 of the cup structure 26. A guide hole 52 is formed in the center of the top surface 34 of the guide bonnet 40. The guide hole 52 atop the guide bonnet 40 is concentric with the vent hole 50 at the bottom of the guide bonnet 40. However, the guide hole 52 has a larger diameter than does the vent hole 50.

A valve stem 54 is provided. The valve stem 54 has a first end 56 and an opposite second end 58. A first end 56 of the valve stem 54 is shaped and sized to plug the vent hole 50 in the bottom surface 42 of the guide bonnet 40. A flange stop 60 is disposed on the valve stem 54 near the first end 56. The flange stop 60 limits the movement of the valve stem 54 toward the bottom surface 36 of the guide bonnet 40, as will be later explained. The valve stem 54 has fluted grooves 62 on its exterior that extend between the flange stop 60 and the second end 58. The second end 58 of the valve stem 54 is anchored to the axe shaped head 12.

A spring 64 is provided around the valve stem 54 within the inner chamber 48 of the guide bonnet 40. The spring 64 extends between the top of the inner chamber 48 and the flange stop 60 of the valve stem 54. The spring 64 is sized to bias the flange stop 60 toward the bottom of the inner chamber 48. As a result, the flange stop 60 is pressed against the bottom of the inner chamber 48 and the first end 56 of the valve stem 54 seats in the vent hole 50. The first end 56 of the valve stem 54 seals the vent hole 50 and prevents air from passing.

The guide bonnet 40 and the remainder of the automatic vent valve 25 are disposed within a clamshell mold anchor 70. The clamshell mold anchor 70 (FIG. 2) that closes around the guide bonnet 40, therein connecting the guide bonnet 40 to the molded axe-shaped head 12. The clamshell mold anchors 70 are separately molded from a plastic that has a melting point significantly higher than that of the polymeric foam 22 used in the axe-shaped head 12 of the projectile toy 10.

In manufacturing, the suction cup assemblies 20 are separately molded. The guide bonnets 40 of the suction cup assemblies 20 are then captured within the clamshell mold anchors 70. The clamshell mold anchors 70 are placed within an injection molding machine that uses an insert mold. The polymeric foam 22 is injected into the mold, wherein the polymeric foam 22 envelops the clamshell mold anchors 70 and the reinforcement elements 24. The result is a projectile toy 10 with an axe-shaped head 12 and a handle 14 made of polymeric foam 22 and a plurality of suction cup assemblies 20 extending therefrom.

Figure 4:
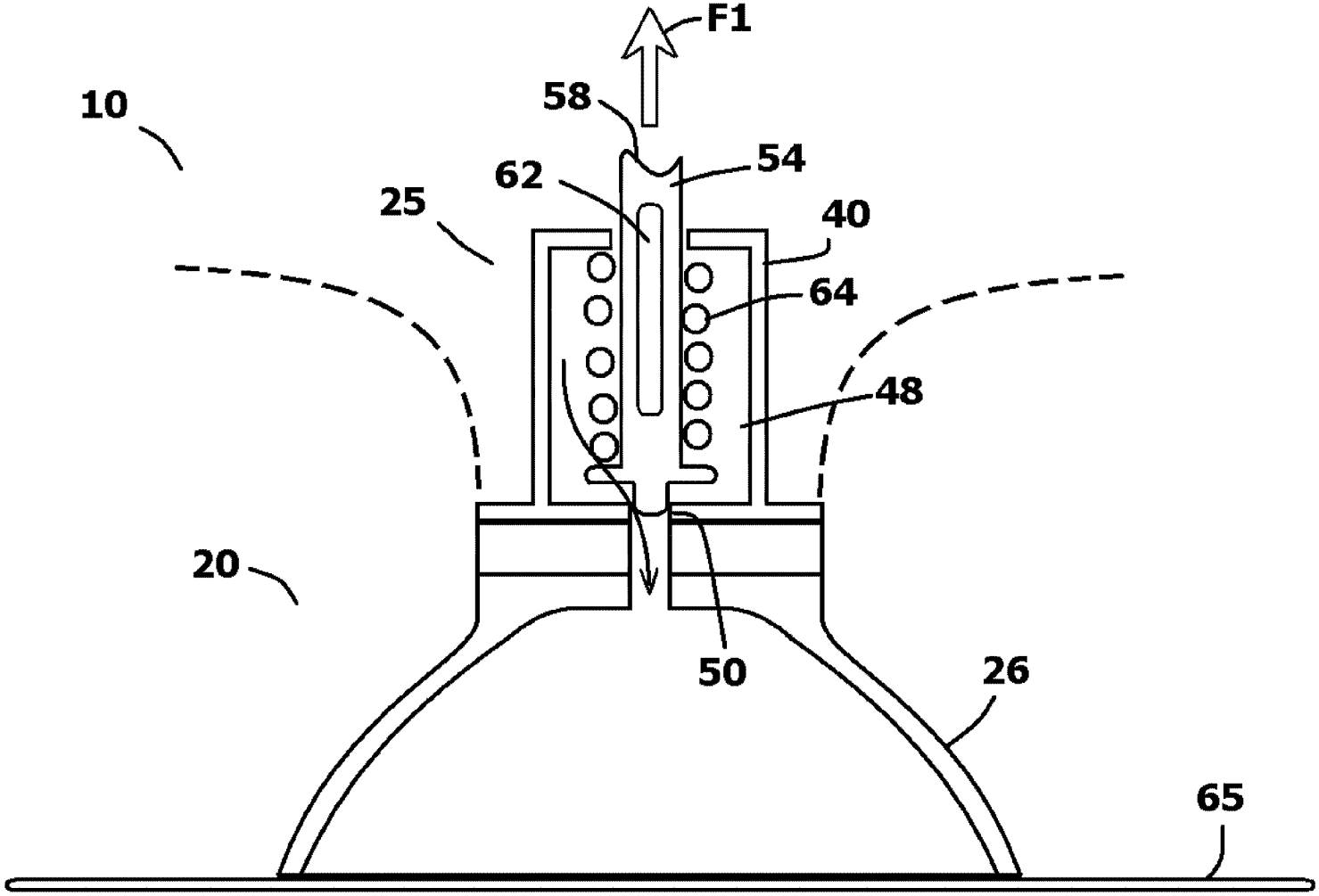
FIG. 4 shows the automatic vent valve used in the exemplary embodiment in an open venting condition.

Referring FIG. 3 in conjunction with FIG. 4, the operation of the automatic vent valve 25 will be understood. FIG. 3 shows a suction cup assembly 20 in a first position moments after impact with a flat surface 65. In this first position, the momentum of the projectile toy 10 biases the suction cup assembly 20 against the flat surface 65. At this moment, the automatic vent valve 25 is fully closed. Within the automatic vent valve 25, the valve stem 54 is anchored to the axe-shaped head 12. Accordingly, as the impact forces the cup structure 26 in the direction of arrows 66, the valve stem 54 is biased in the opposite direction that is in the direction of arrow 68. The valve stem 54 is further biased in the direction of arrow 68 by the spring 64. The bias causes the first end 56 of the valve stem 54 to plug the vent hole 50 in the bottom surface 42 of the guide bonnet 40 and the underlying vent conduit 38. As a result, the cup structure 26 is not vented. The cup structure 26 will therefore perform in the same manner as an ordinary suction cup and will adhere to the flat surface 65.

In FIG. 4, the suction cup assembly 20 is shown in a second position where the suction cup assembly 20 is being pulled away from the flat surface 65. Accordingly, a force F1 is being applied to the projectile toy 10. The second end 58 of the valve stem 54 is anchored to the body 15. Consequently, the pulling force F1 is transferred directly to the valve stem 54. The cup structure 26 is adhered to the flat surface 65 with suction, in the usual manner for a suction cup. The result is that the cup structure 26 sticks to the flat surface 65 and opposes the pulling force F1. The opposing forces are experienced by opposite sides of the spring 64 inside the guide bonnet 40. The spring 64 compresses. As a result, the first end 56 of the valve stem 54 lifts up out of the vent hole 50. Once the valve stem 54 is clear of the vent hole 50, air is able to flow into the cup structure 26 from the inner chamber 48 of the guide bonnet 40. Air can enter the guide bonnet 40 through the grooves 62 in the valve stem 54. The result is that the cup structure 26 vents to ambient pressure and suction is lost. The cup structure 26 then immediately falls away from the flat surface 65.

It will therefore be understood that suction can remain in the cup structure 26 after impact with the flat surface 65. The suction remains until the projectile toy 10 is engaged and pulled away from the flat surface 65. Once engaged and pulled, the automatic vent valve 25 vents the pressure in the cup structure 26 and the projectile toy 10 falls away from the flat surface 65. The detachment of the cup structure 26 from the flat surface 65 occurs before the pulling force F1 becomes large enough to damage the projectile toy 10.

Figure 5:
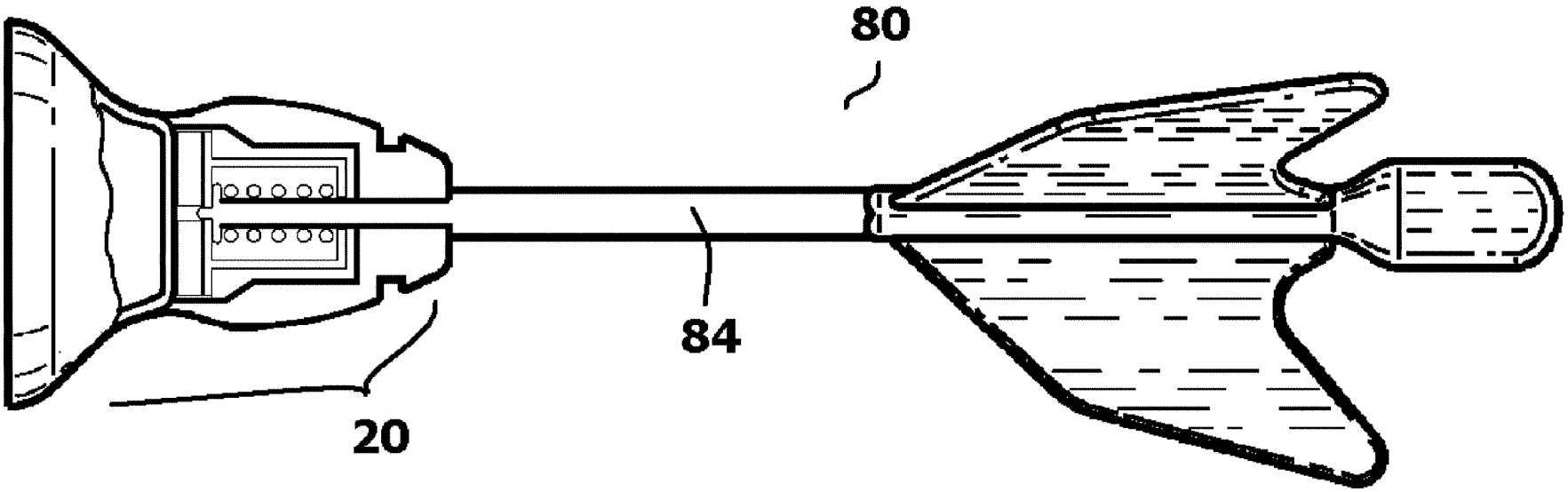
FIG. 5 shows an alternate embodiment of a projectile toy shaped as a dart.

Referring to FIG. 5, a projectile toy 80 is shown. In this embodiment, the projectile toy 80 is formed as an arrow or dart. The projectile toy 80 has a single suction cup assembly 20 at one end of a body 84. The suction cup assembly 20 is the same as was previously described. According, the suction cup assembly 20 will adhere to a flat surface on impact and will automatically vent and release when pulled away from that flat surface.

It will be understood that the embodiments of the present invention that are illustrated and described are merely exemplary and that a person skilled in the art can make many variations to those embodiments. For instance, the size, shape and style of the toy throwing assembly can be changed. All such embodiments are intended to be included within the scope of the present invention as defined by the claims.

What is claimed is:

1. A projectile toy, comprising:

a body;

at least one suction cup assembly extending from said body, wherein said at least one suction cup assembly has a flat central hub, a cup structure capable of adhering to a surface with suction, and a vent valve for venting said cup structure, wherein said vent valve includes a guide bonnet that defines an interior chamber;

a compressible base disc interposed between said flat central hub and said guide bonnet, wherein said compressible base disc has an opening that enables said vent valve to vent said cup structure through said compressible base disc;

wherein said vent valve automatically vents said cup structure only when a pull force is applied to said body that acts to move said cup structure once adhered.

2. The projectile toy according to claim 1, wherein said cup structure is vented through a vent conduit and said vent valve contains a valve stem that selectively closes said vent conduit, wherein said valve stem moves and opens said vent conduit when said pull force is applied to said body.

3. The projectile toy according to claim 2, further including a spring for biasing said valve stem against said vent conduit to close said vent conduit.

4. The projectile toy according to claim 3, wherein said valve stem has a first end that selectively obstructs said vent conduit and an opposite second end that is affixed to said body.

5. The projectile toy according to claim 1, wherein said guide bonnet has a vent hole and a guide hole that are concentrically aligned on opposite sides of said interior chamber, wherein said vent hole aligns with said vent conduit.

6. The projectile toy according to claim 5, wherein said valve stem extends through said guide hole into said internal chamber.

7. The projectile toy according to claim 6, further including a spring in said interior chamber of said guide bonnet that biases said valve stem against said valve hole.

8. A projectile toy, comprising:

a head having a face surface;

a handle extending from said head wherein said handle extends from said head in a primary direction;

a plurality of suction cups extending from said face surface of said head, wherein said suction cups are capable of adhering to a surface with suction, and at least one of said plurality of suction cups is oriented at a perpendicular to said primary direction;

vent valves for venting said plurality of suction cups;

wherein said vent valves automatically vent any of said suction cups adhered to said surface with suction only when a pull force is applied to said head that acts to move said cup structure said surface.

9. The projectile toy according to claim 8, wherein said face surface is curved.

10. The projectile toy according to claim 8, wherein each of said vent valves has a valve stem, wherein said valve stem moves and opens a vent conduit when said pull force is applied to said head.

11. The projectile toy according to claim 10, further including a spring for biasing said valve stem against said vent conduit to close said vent conduit.

12. A projectile toy, comprising:

a body having a face surface that is curved and wherein a plurality of suction cups extend from said face surface;

a handle extends from said body in a primary direction wherein at least one of said plurality of suction cups is oriented at a perpendicular to said primary direction;

wherein each of said plurality of suction cups has a valve stem anchored to said body;

wherein each of said plurality of suction cups can move relative to said valve stem between a first position and a second position, wherein said valve stem blocks said vent hole when in said first position and opens said vent hole when in said second position;

wherein said suction cup is moved to said second position when said body is biased away from said plurality of suction cups.

13. The projectile toy according to claim 12, further including a spring for biasing said valve stem into said first position.

* * * * *